US007967107B2

(12) United States Patent
Han et al.

(10) Patent No.: US 7,967,107 B2
(45) Date of Patent: Jun. 28, 2011

(54) MUFFLER APPARATUS FOR VEHICLE

(75) Inventors: Hak-Son Han, Sungnam-shi (KR); Je-Hui Jun, Suwon-shi (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/623,017

(22) Filed: Nov. 20, 2009

(65) Prior Publication Data

US 2011/0048848 A1 Mar. 3, 2011

(30) Foreign Application Priority Data

Sep. 3, 2009 (KR) ..... 10-2009-0082858

(51) Int. Cl.
*F01N 1/00* (2006.01)

(52) U.S. Cl. ..... 181/254; 181/227; 181/212; 181/237

(58) Field of Classification Search ..... 181/212, 181/227, 254
See application file for complete search history.

(56) References Cited

U.S. PATENT DOCUMENTS

| | | | | |
|---|---|---|---|---|
| 5,392,602 | A * | 2/1995 | Matsumoto | 60/299 |
| 5,708,237 | A * | 1/1998 | Maeda et al. | 181/254 |
| 6,176,347 | B1 * | 1/2001 | Chae et al. | 181/254 |
| 6,189,650 | B1 * | 2/2001 | Inuzuka et al. | 181/254 |
| 7,066,296 | B2 * | 6/2006 | Uegane et al. | 181/254 |
| 7,416,052 | B2 * | 8/2008 | Mabuchi et al. | 181/272 |
| 2001/0045322 | A1 * | 11/2001 | Nilsson et al. | 181/227 |

FOREIGN PATENT DOCUMENTS

| | | | |
|---|---|---|---|
| JP | 06248930 | A * | 9/1994 |
| JP | 10-61424 | A | 3/1998 |
| JP | 11-200835 | A | 7/1999 |
| JP | 2006-283644 | A | 10/2006 |
| KR | 10-2009-0064161 | A | 6/2009 |

* cited by examiner

*Primary Examiner* — Forrest M Phillips
(74) *Attorney, Agent, or Firm* — Morgan, Lewis & Bockius LLP

(57) ABSTRACT

A muffler apparatus for a vehicle, may include a muffler housing; baffle plates that are disposed in the muffler housing and divides an internal space of the muffler housing; an intake pipe that is supported by at least one of the baffle plates and takes in exhaust gas; and an exhaust pipe that is supported by at least one of the baffle plates and takes in the exhaust gas discharged from the intake pipe and discharges the exhaust gas outside the muffler housing, and of which a pipe line of the exhaust pipe circulates through the internal space of the muffler housing.

4 Claims, 4 Drawing Sheets

MUFFLER APPARATUS FOR VEHICLE

CROSS-REFERENCE TO RELATED APPLICATION

The present application claims priority to Korean Patent Application No. 10-2009-82858, filed on Sep. 3, 2009, the entire contents of which is incorporated herein for all purposes by this reference.

BACKGROUND OF THE INVENTION

1. Field of the Invention

The present invention relates to a muffler apparatus reducing exhaust noise of exhaust gas of vehicles, in detail, a muffler apparatus for a vehicle which is characterized by having a configuration reducing booming noise and back pressure by the exhaust gas flowing inside the muffler apparatus, by using a U-shaped exhaust pipe.

2. Description of Related Art

In general, mufflers used for vehicles perform a function of reducing exhaust noise generated by exhaust gas that vehicles discharge.

FIG. 1 shows a muffler apparatus for vehicles in the related art, in which the muffler apparatus 1 of the related art includes pipes for taking in or discharging exhaust gas, baffle plates that support the pipes and form a sound absorption chamber and a resonance chamber for the exhaust gas, and variable valves that are provided on the baffle plates and of which the discharge amount is adjusted in accordance with the exhaust pressure of the exhaust gas Describing in detail the configuration of the muffler apparatus 1 of the related art, the exhaust gas generated while the engine of a vehicle operates passes through a catalytic device that purifies components which are harmful to human body, such as carbon monoxide or nitrogen compound, and then flows to an inlet 11 of an intake pipe 10 of the muffler apparatus 1 through an exhaust system.

Further, the exhaust gas from vehicles flows into the inlet 11 of the intake pipe 10, and then the exhaust gas that has flowed inside is discharged to an outlet 12 of the intake pipe 10 that is formed through a first baffle plate 41, second baffle plate 42, and the third baffle plate 43, in which the outlet 12 is disposed in the fourth chamber A4 formed behind the third baffle plate 43.

The exhaust gas discharged inside the fourth chamber A4 through the outlet 12 returns to the first chamber A1 sequentially through the fourth chamber A4, the third chamber A3, the second chamber A2, which are divided by the first baffle plate 41, second baffle plate 42, and third baffle plate 43, and a variable valve 30 attached to the first baffle plate 41, such that booming of the exhaust gas is reduced by expansion, contraction, and interference of the exhaust gas during the return process.

In this configuration, in order to implement the return process of the exhaust gas, air-through holes (not shown) for flow of the exhaust gas are formed through the first baffle plate 41, second baffle plate 42, and third baffle plate 43.

Subsequently, the exhaust gas that has returned in the first chamber A1, as described above, flows into an exhaust pipe 20 with an inlet 21 ahead of the first baffle plate 41.

The exhaust pipe 20 is disposed through the second baffle plate 42, the third baffle plate 43, and a muffler housing 50 formed to have the outer shape of the muffler apparatus, and the exhaust gas is discharged outside the muffler apparatus 1 through an outlet 22, which is open to the outside of the muffler housing 50, of the exhaust pipe 20.

In this configuration, a sound absorption material, such as glass wool, may be filled in the second chamber A2 formed between the first baffle plate 41 and the second baffle plate 42 in order to improve sound absorption.

However, the performance of the muffler apparatus 1 of the related art is slightly insufficient in effectively blocking a large noise that is generated from high-performance engines that have recently been developed. For example, the discharge sound of exhaust gas when a vehicle starts is too loud or the maximum output of engines is slightly reduced because the back pressure is not effectively controlled.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a muffler apparatus for a vehicle that makes it possible to achieve quiet traveling by reducing noise from exhaust gas of a high-output engine, and to maintain the output of the engine by reducing back pressure generated by the exhaust gas and to reduce booming noise and back pressure by the exhaust gas flowing inside the muffler apparatus, by using a U-shaped exhaust pipe.

In an aspect of the present invention, the muffler apparatus for a vehicle, may include a muffler housing; baffle plates that are disposed in the muffler housing and divides an internal space of the muffler housing; an intake pipe that is supported by at least one of the baffle plates and takes in exhaust gas; and an exhaust pipe that is supported by at least one of the baffle plates and takes in the exhaust gas discharged from the intake pipe and discharges the exhaust gas outside the muffler housing, and of which a pipe line of the exhaust pipe circulates through the internal space of the muffler housing.

The pipe line of the exhaust pipe may be formed in a U-shape.

The baffle plates may include a first baffle plate at a front portion of the muffle housing, a second baffle plate at a middle portion thereof, and a third baffle plate at a rear portion thereof, and wherein the internal space of the muffler housing is divided into a first chamber, a second chamber, a third chamber, and a fourth chamber in series by the first baffle plate, the second baffle plate, and the third baffle plate.

The intake pipe may have an inlet formed through the front portion of the muffler housing inside the muffler housing, and an outlet disposed in the second chamber through the first baffle plate, wherein the exhaust pipe has an inlet disposed in the fourth chamber and an outlet formed through the rear portion of the muffler housing to be communicated with the outside.

The pipe line of the exhaust pipe may circulate through the third baffle plate, the second baffle plate, the first baffle plate in series and then the first baffle plate, the second baffle plate, and the third baffle plate in series to form a U-shape.

Air-through holes that allow the exhaust gas flowing inside through the intake pipe to flow into the inlet of the exhaust pipe may be formed in the first, second, and third baffle plates, and a variable valve of which an opening/closing amount is variably changed by a discharge pressure of the exhaust gas that is discharged from the outlet of the intake pipe through the air-through hole formed in the second baffle plate, is attached to the second baffle plate.

A double pipe sound absorption tube filled with a sound absorption material may be attached to the exhaust pipe.

Holes for discharging the exhaust gas to the first chamber may be formed through the intake pipe in the front portion of the muffle housing.

In various aspects of the present invention, the muffler apparatus for a vehicle having the above configuration has the advantage of firstly reducing high-frequency noise of exhaust gas while the exhaust gas flowing into an intake pipe passes through a first chamber to a fourth chamber, and secondarily reducing high-frequency noise and low-frequency noise of the remaining bandwidth of the exhaust gas, using an exhaust pipe having a long U-shape pipe line, thereby effectively reducing noise and backpressure of the exhaust gas.

Further, the present invention has the advantage of reducing noise at a low velocity and preventing the output of the engine from decreasing at a high velocity by reducing back pressure, by changing the characteristics of the elastic member of the variable valve.

Further, the present invention has the advantage of improving the linearity of noise from exhaust gas that is discharged outside by removing the resonance chamber that is used in muffler apparatuses in the related art, and implementing exhaust sound that is not unpleasant to a driver while constantly increasing the sound pressure of exhaust gas in accordance with the increase in the number of revolution (RPM) of an engine, as compared with the related art.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
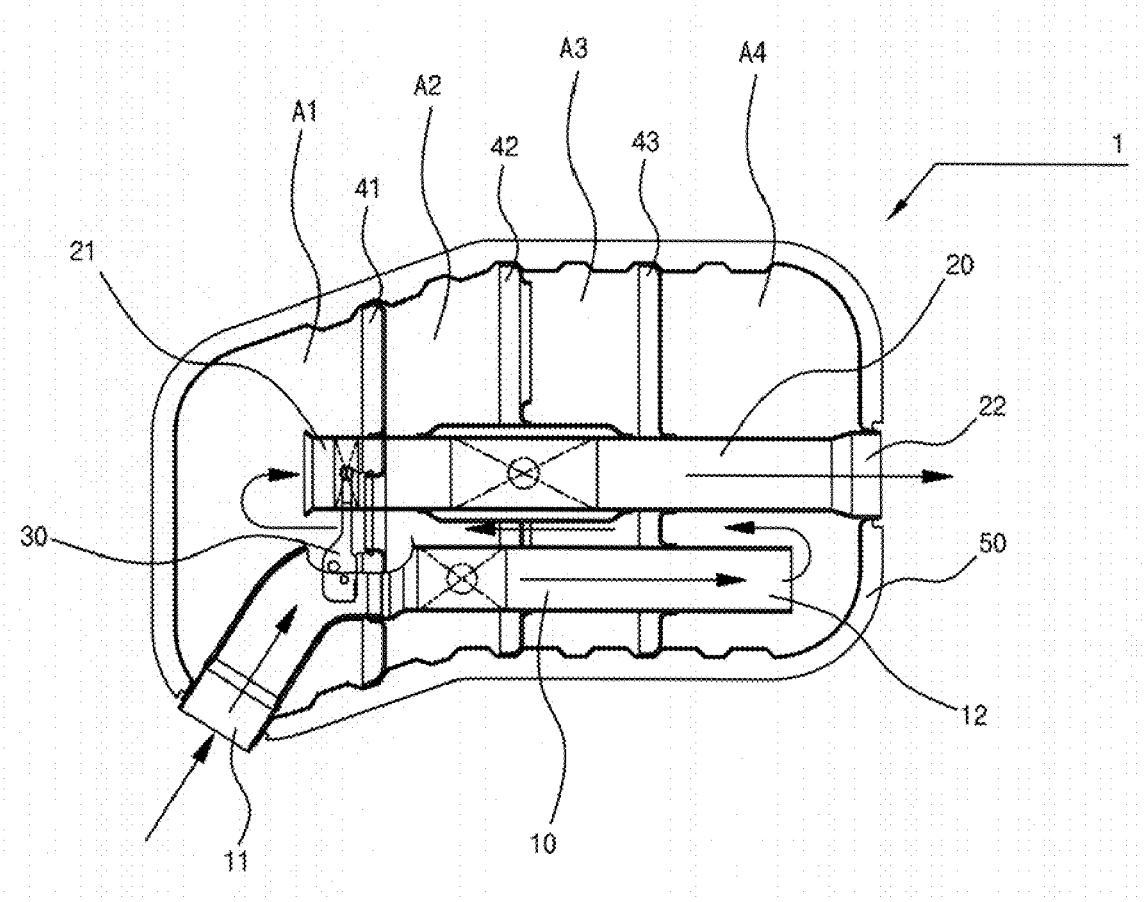
FIG. 1 (Prior Art)
FIG. 1 is a view illustrating the configuration of a muffler apparatus in the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Hereinafter, the configuration of a preferred embodiment of a muffler apparatus for a vehicle according to an exemplary embodiment of the present invention is described in detail with the accompanying drawings.

Figure 2:
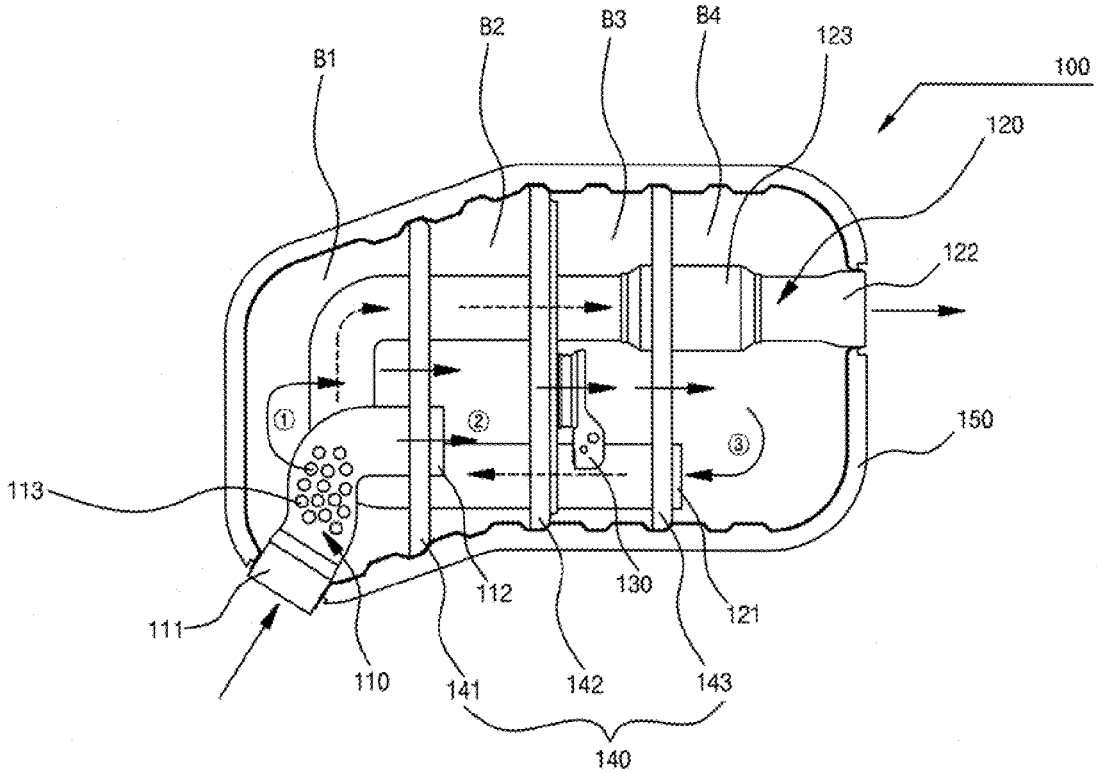
FIG. 2 is a view illustrating the configuration of a muffler apparatus in accordance with an exemplary embodiment of the present invention.

FIG. 2 is a view illustrating the configuration of a muffler apparatus, according to an exemplary embodiment of the present invention. The muffler apparatus 100 in an exemplary embodiment of the present invention, includes a muffler housing 150 that forms the outer shape of the apparatus, a baffle plates 140 that are disposed in the muffler housing 150, an intake pipe 110 that is supported by the baffle plates 140 and takes in exhaust gas, and an exhaust pipe 120 that is supported by the baffle plates 140 and takes in the exhaust gas discharged from the intake pipe 110 and discharges it outside the muffler housing 150, and of which the pipe line circulates through the internal space of the muffler housing 150 which is divided by the baffle plates 140.

The baffle plates 140 divide the space for return the exhaust gas in the inflow direction of the exhaust pipe 120, and include a first baffle plate 141 at the front, a second baffle plate 142 at the middle, and a third baffle plate 143 at the rear.

In this configuration, though not shown, air-through holes 135 that allow the exhaust gas flowing inside through the intake pipe 110 to flow into an inlet 121 of the exhaust pipe 120 are formed through the first baffle plate 141 and the third baffle plate 143.

The inside of the housing 150 of the muffler apparatus 100 are, as in the muffler apparatus of the related art described above, divided into a first chamber B1, a second chamber B2, a third chamber B3, and a fourth chamber B4, by the first baffle plate 141, second baffle plate 142, and third baffle plate 143.

The intake pipe 110 has an inlet 111 formed through a portion of the front of the housing 150, inside the housing 150, and an outlet 112 disposed in the second chamber B2 through the first baffle plate 141.

In this configuration, holes 113 for discharging the exhaust gas, which flows inside, to the first chamber B1 are formed at the inlet 111 of the intake pipe 110, in order to attenuate a high-frequency rough sound of the exhaust gas inside.

Further, the exhaust pipe 120 has the inlet 121 disposed in the fourth chamber B4 and an outlet 122 formed through a portion of the rear of the housing 150 to be communicated with the outside of the housing 150 such that the pipe line is formed in a U-shape.

That is, the pipe line of the exhaust pipe 120 extends from the rear of the third baffle plate 143, that is, the inlet 121 disposed in the fourth chamber B4 to the inside of the first chamber B1 through the second baffle plate 142 and the first baffle plate 141, and curves in the first chamber B1 and returns to the outlet 122 communicated to the outside of the housing 150, through the first baffle plate 141, second baffle plate 142, and third baffle plate 143.

Meanwhile, a double pipe sound absorption tube 123 filled with an absorption material for reducing high frequency noise is attached near the outlet 122 of the exhaust pipe 120.

Further, the muffler apparatus, in an exemplary embodiment of the present invention, includes a variable valve 130 attached to the second baffle plate 142.

The variable plate 130 is a valve of which the opening/closing amount is variably adjusted by the back pressure from the exhaust gas that is discharged from the outlet 112 of the intake pipe 110, and which is attached to the rear of the second baffle plate 142.

Figure 3:
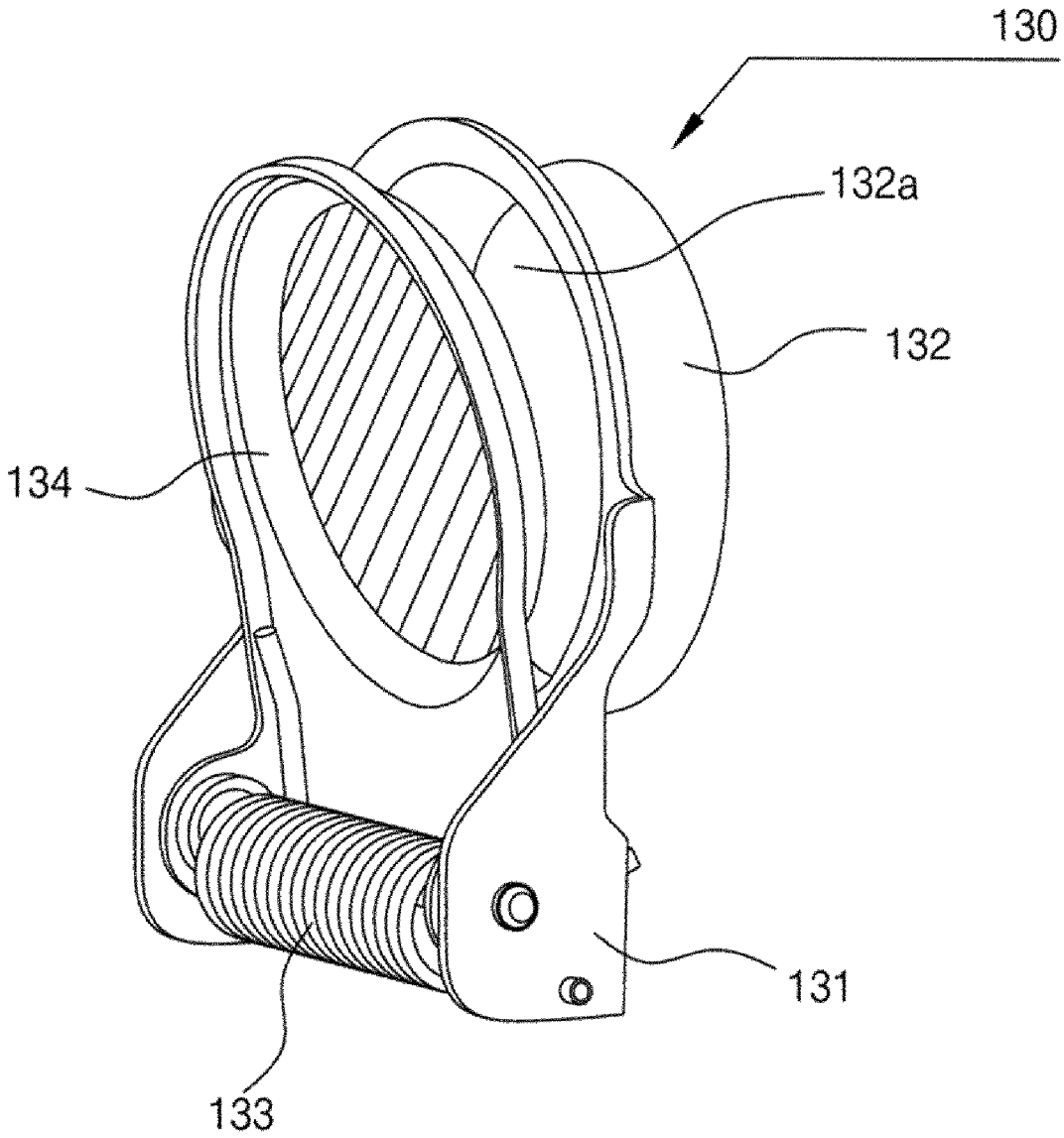
FIG. 3 is a view illustrating the configuration of a variable valve of the muffler apparatus in accordance with an exemplary embodiment of the present invention.

The variable valve 130, as shown in the perspective view of the variable valve 130 of FIG. 3, has a valve body 131 that has an elastic member 133 at the lower portion and a ring 132 with an opening 132*a*, though which exhaust gas passes, at the upper portion, and a valve cork 134 that is hinged to the valve body 131 and rotated forward and backward by elasticity of the elastic member 133 to open/close the valve.

The valve cork 134 opens or closes the variable valve 130 by rotating forward or backward by the back pressure from the exhaust gas flowing inside through the ring 132, and it is preferable to use a general spring as the elastic member 133.

The muffler apparatus for a vehicle having the above configuration according to an exemplary embodiment of the present invention has a structure in which the high-frequency noise of exhaust gas flowing into the intake pipe 110 is firstly reduced while the exhaust gas passes through the first chamber B1 to the fourth chamber B4, and then the high-frequency noise and low-frequency noise of the remaining bandwidth of the exhaust gas are secondarily reduced while the exhaust gas is discharged outside the muffler apparatus through the exhaust pipe 120 having the U-shaped long pipe line, such that noise generated from the exhaust gas is reduced.

The operation of the muffler apparatus 100 for a vehicle having the above configuration according to an exemplary embodiment of the present invention is described hereafter in detail.

First, a portion of the exhaust gas flowing into the intake pipe 110 through the inlet 111 leaks into the first chamber B1 through the holes 113 formed near the inlet of the intake pipe 110 while high-frequency booming is reduced, and then it flows into the second chamber B2 through the air-through holes 135 formed through the first baffle plate 141.

Further, the other of the exhaust gas flowing through the inlet 111 flows through the intake pipe 110 and is then discharged into the second chamber B2 through the outlet 112.

As described above, since the exhaust gas flows into the second chamber B2 through two routes, reduction of noise from the exhaust gas can be maximized due to interference between the noises of the exhaust gases flowing along different routes.

Subsequently, as the exhaust gas that has flowed in the second chamber B2 flows into the opening 132*a* of the ring 132 of the variable valve 130 attached to the second baffle plate 142, the valve cork 134 hinged to the valve body 131 is opened by elastic force of the elastic member 133, which is generated by back pressure of the exhaust gas flowing inside through the opening 132*a*, and a flow channel of the exhaust gas is formed through the opened valve cork 134, such that the exhaust gas in the second chamber B2 flows into the third chamber B3 and the exhaust gas flowing in the third chamber B3 continues flowing into the fourth chamber B4 through the air-through holes 135 formed through the third chamber B3.

By using the variable valve 130 described above, the muffler apparatus of the present invention can efficiently reduce the variable noise and back pressure that are caused when a vehicle changes velocity from low to high velocity, in accordance with the opening/closing amount of the variable valve 130.

High-frequency rough noise and the back pressure of the exhaust gas are reduced while the exhaust gas flowing into the intake pipe 110 through the inlet 111 by the above process sequentially passes through the first chamber B1, second chamber B2, third chamber B3, and fourth chamber B4.

Next, the exhaust gas discharged into the fourth chamber B4 flows into the exhaust pipe 120 through the inlet 121 formed through the third baffle plate 143, and low-frequency rough noise in the remaining bandwidth is maximally reduced while the exhaust gas flows through the pipe line of the long U-shaped (also called 'Long tail') exhaust pipe 120, and then the exhaust gas is discharged outside through the outlet 122 of the exhaust pipe 120, which is communicated to the outside of the housing 150.

High-frequency noise is attenuated again while the exhaust gas passes through the double pipe sound absorption tube 123 filled with an absorption material, which is disposed near the outlet 122 of the exhaust pipe 120.

On the other hand, the muffler apparatus 100 of the present invention which operates as described above can further improve the noise reduction efficiency, using the elasticity of the elastic member 133 attached to the variable valve 130.

Figure 4:
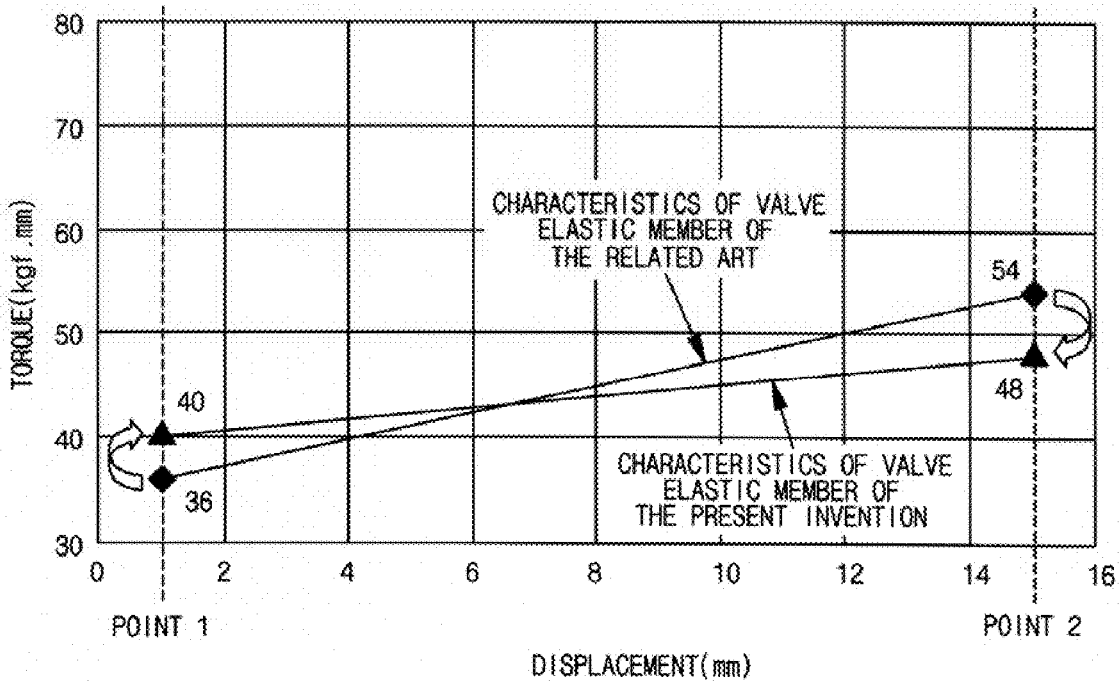
FIG. 4 is a graph showing characteristics of an elastic body of the variable valve in accordance with an exemplary embodiment of the present invention.

That is, as shown in the graph of FIG. 4, which shows characteristics of the elastic member of the variable member of the present invention, according to the characteristics of the elastic member attached to the variable member of the present invention, since the elastic coefficient of the elastic member is larger at low torque than that of those in the related art, the opening amount of the variable valve is small at a low velocity, such that this is advantageous in reducing booming in the early operation of the engine (particularly, in starting the engine). Further, since the elastic coefficient of the elastic member is smaller at high torque than that of those in the related art, the opening amount of the variable valve is large at a high velocity, such that the output of the engine is further increased.

The performance of the muffler apparatus 100 of the present invention which operates as described above was shown in the following Table 1.

TABLE 1

Performance Experiment of Muffler Apparatus of the Present Invention

| Item | Muffler apparatus in the related art | Muffler apparatus of the present invention | Reference |
|---|---|---|---|
| C2 booming noise level | 99 dB | 95 dB | noise reduced by 4 dB |
| Back pressure | 65 kPa | 63 kPa | back pressure reduced by 2 kPa |

As shown in Table 1, in terms of C2 booming noise level that is a reference of noise level, it was reduced by 4 dB by the muffler apparatus of the present invention, as compared with the muffler apparatus of the related art, and the back pressure is also reduced by 2 kPa, as compared with the muffler apparatus of the related art.

This is because, as compared with the muffler apparatus of the related art, the high-frequency noise of the exhaust gas was firstly reduced while the exhaust gas flowing into the intake pipe 110 passes through the first chamber B1 to the fourth chamber B4, and the high-frequency noise and the low-frequency noise in the remaining bandwidth of the exhaust gas were secondarily reduced while the exhaust gas passes through the exhaust pipe 120 having the U-shaped long pipe line, such that noise and back pressure generated by the exhaust gas were effectively reduced.

Further, it is possible to further reduce noise at a low velocity and prevent the output of the engine from decreasing at a high velocity by reducing back pressure, as compared with the muffler apparatus in the related art, by changing the characteristics of the elastic member of the variable valve.

Further, the linearity of noise from exhaust gas that is discharged outside was improved by removing the resonance chamber that is used in muffler apparatuses in the related art, such that it was possible to implement exhaust sound that is not unpleasant to a driver while constantly increasing the sound pressure of exhaust gas in accordance with the increase in the number of revolutions (RPM) of an engine, as compared with the related art.

For convenience in explanation and accurate definition in the appended claims, the terms "upper" or "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler apparatus for a vehicle, comprising:

a muffler housing;

baffle plates that are disposed in the muffler housing and divide an internal space of the muffler housing;

an intake pipe that is supported by at least one of the baffle plates and takes in exhaust gas; and an exhaust pipe that is supported by at least one of the baffle plates and takes in the exhaust gas discharged from the intake pipe and discharges the exhaust gas outside the muffler housing, and of which a pipe line of the exhaust pipe circulates through the internal space of the muffler housing;

wherein the pipe line of the exhaust pipe is formed in a U-shape;

wherein the baffle plates include a first baffle plate at a front portion of the muffle housing, a second baffle plate at a middle portion thereof, and a third baffle plate at a rear portion thereof;

wherein the internal space of the muffler housing is divided into a first chamber, a second chamber, a third chamber, and a fourth chamber in series by the first baffle plate, the second baffle plate, and the third baffle plate;

wherein the intake pipe has an inlet formed through the front portion of the muffler housing inside the muffler housing, and an outlet disposed in the second chamber through the first baffle plate; and wherein the exhaust pipe has an inlet disposed in the fourth chamber and an outlet formed through the rear portion of the muffler housing to be communicated with the outside;

wherein the pipe line of the exhaust pipe circulates through the third baffle plate, the second baffle plate, the first baffle plate in series and then the first baffle plate, the second baffle plate, and the third baffle plate in series to form a U-shape.

2. The muffler apparatus for the vehicle according to claim 1, wherein air-through holes that allow the exhaust gas flowing inside through the intake pipe to flow into the inlet of the exhaust pipe are formed in the first, second, and third baffle plates, and a variable valve of which an opening/closing amount is variably changed by a discharge pressure of the exhaust gas that is discharged from the outlet of the intake pipe through the air-through hole formed in the second baffle plate, is attached to the second baffle plate.

3. The muffler apparatus for the vehicle according to claim 1, wherein a double pipe sound absorption tube filled with a sound absorption material is attached to the exhaust pipe.

4. The muffler apparatus for the vehicle according to claim 1, wherein holes for discharging the exhaust gas to the first chamber are formed through the intake pipe in the front portion of the muffler housing.

* * * * *